US005992378A

United States Patent [19]

Parkinson

[11] Patent Number: 5,992,378

[45] Date of Patent: Nov. 30, 1999

[54] SELF-ALIGNING THROTTLE PLATE

[75] Inventor: Timothy Michael Parkinson, Livonia, Mich.

[73] Assignee: Ford Motor Company, Dearborn, Mich.

[21] Appl. No.: 09/047,561

[22] Filed: Mar. 25, 1998

[51] Int. Cl.[6] ..... F02D 9/10

[52] U.S. Cl. ..... 123/337; 29/890.12

[58] Field of Search ..... 123/337; 29/890.12

[56] References Cited

U.S. PATENT DOCUMENTS

| | | | |
|---|---|---|---|
| 1,841,695 | 1/1932 | Anderson | 251/308 |
| 2,529,572 | 11/1950 | Raybould | 251/308 |
| 4,972,815 | 11/1990 | Yamamoto et al. | 123/337 |
| 5,275,375 | 1/1994 | Semence | 251/308 |
| 5,311,849 | 5/1994 | Lambert et al. | 123/337 |
| 5,492,097 | 2/1996 | Byram et al. | 123/396 |
| 5,666,988 | 9/1997 | Becker | 137/15 |

FOREIGN PATENT DOCUMENTS

| | | | |
|---|---|---|---|
| 205327 | 9/1986 | Japan | 123/337 |

*Primary Examiner*—Tony M. Argenbright
*Assistant Examiner*—Arnold Castro
*Attorney, Agent, or Firm*—Roger L. May

[57] ABSTRACT

A throttle body assembly for an internal combustion engine comprising a straddle-mounted throttle plate shaft extending transversely through an airflow passage, a bearing located on each side of the airflow passage for rotatably supporting the throttle plate shaft, and a mechanical connection between the throttle plate and the throttle plate shaft including strategically positioned clearances between the shaft and the throttle plate which will allow the throttle plate to move relative to the shaft, thereby permitting self-alignment of the throttle plate within the airflow passage.

1 Claim, 3 Drawing Sheets

SELF-ALIGNING THROTTLE PLATE

TECHNICAL FIELD

The invention relates to internal combustion engines, particularly throttle assemblies for controlling flow of an air/fuel mixture.

BACKGROUND OF THE INVENTION

An air/fuel mixture for an internal combustion engine is delivered to the engine intake manifold through an air/fuel mixture flow passage formed in a throttle body. It is conventional design practice in the case of an engine having an air/fuel mixture carburetor to provide a throttle plate situated in the throttle body on the downstream side of a carburetor venturi. Fuel distribution to the intake air is developed by reason of the venture pressure. In the case of an internal combustion engine having a fuel injection system, the throttle plate would be located in the throttle body in the airflow path between the air intake duct and the engine air intake manifold. The flow of air or the flow of an air/fuel mixture through the throttle body is controlled by the throttle plate as the position of the throttle plate is adjusted by a throttle valve actuator. The actuator may be in the form of a driver-operated linkage or a throttle controller such as an electrical stepper motor.

The throttle plate may be mounted on a throttle shaft that extends through the throttle body passage, hereinafter referred to as an airflow passage. Spaced bearings in the throttle body rotatably support the throttle shaft in a straddle mount arrangement. An example of a throttle body having a throttle plate of this kind may be seen by referring to U.S. Pat. Nos. 5,492,097 and 1,841,695. Each of these prior art throttle valve assemblies includes a circular valve plate situated in a cylindrical airflow passage in the throttle body.

One problem associated with a throttle valve assembly of the kind shown in the '097 and '695 patents is a tendency of the valve plate to frictionally engage the wall of the airflow passage, thereby creating an undesirable binding or sticking of the valve plate which prevents normal throttle valve adjustments. Valve plate sticking is more prevalent when the valve plate assumes a closed throttle position.

Attempts have been made to overcome the valve plate sticking problem by providing for a lost motion connection between the throttle plate shaft and the throttle plate itself in instances when the throttle valve plate shaft is journalled in the throttle body in a cantilever fashion. Such an arrangement is shown in prior art patent U.S. Pat. No. 5,311,849, where a pin-and-slot connection is provided between a cantilever-mounted throttle shaft and a throttle plate so that any binding tendency of the throttle plate is reduced. The cantilever throttle plate mounting arrangement of the '849 patent provides for a floating movement of the throttle plate relative to a relatively stable bearing mount for the cantilever throttle shaft. The design does not make specific provision for allowing flexure of the throttle plate due to a pressure differential that would exist across the throttle plate when the throttle plate assumes a closed position. Neither does it make provision for reducing to a minimum leakage of air through the lost motion connection with the throttle is closed.

BRIEF SUMMARY OF THE INVENTION

It is an objective of the present invention to provide a robust and stable throttle plate mounting arrangement for a throttle plate in an airflow passage of a throttle body wherein each end of a throttle supporting shaft is mounted in spaced throttle shaft bearings in a straddle mount fashion. The improved throttle plate assembly of the invention, in accordance with one embodiment, comprises a straddle mounted throttle shaft that has an axially extending slot that receives the throttle plate. The slot extends diametrically across the throttle plate. Sufficient clearance is provided between the walls of the slot and the throttle plate to permit a floating action of the throttle plate relative to the axis of the throttle shaft while avoiding extensive air leakage past the throttle plate during closed-throttle operation of the engine. The throttle plate can be dimpled or otherwise provided with projections that limit shifting motion of the throttle plate relative to the axis of the throttle plate shaft in a transverse direction.

Floating movement of the throttle plate relative to the throttle body, in accordance with another embodiment of the invention, is established by a centering pin or screw extending transversely through the throttle shaft. The pin or screw is received in an oversized clearance hole in the throttle plate so that the throttle plate may move in a transverse direction with respect to the axis of the throttle shaft to an extent permitted by the clearance between the centering pin and the sides of the clearance hole. The throttle plate can move also in the direction of the axis of the throttle shaft.

Floating movement of the throttle plate relative to the airflow passage in the throttle body minimizes the possibility of friction between the margin of the throttle plate and the airflow passage wall. The throttle plate thus is fully capable of accommodating relatively high differential pressure forces.

It is possible with this arrangement to provide for minimal controlled clearance between the throttle plate and the air passage wall without a tendency for binding between the throttle plate and the throttle body. The minimal clearance will reduce air leakage across the throttle plate.

PARTICULAR DESCRIPTION OF THE INVENTION

Figure 1:
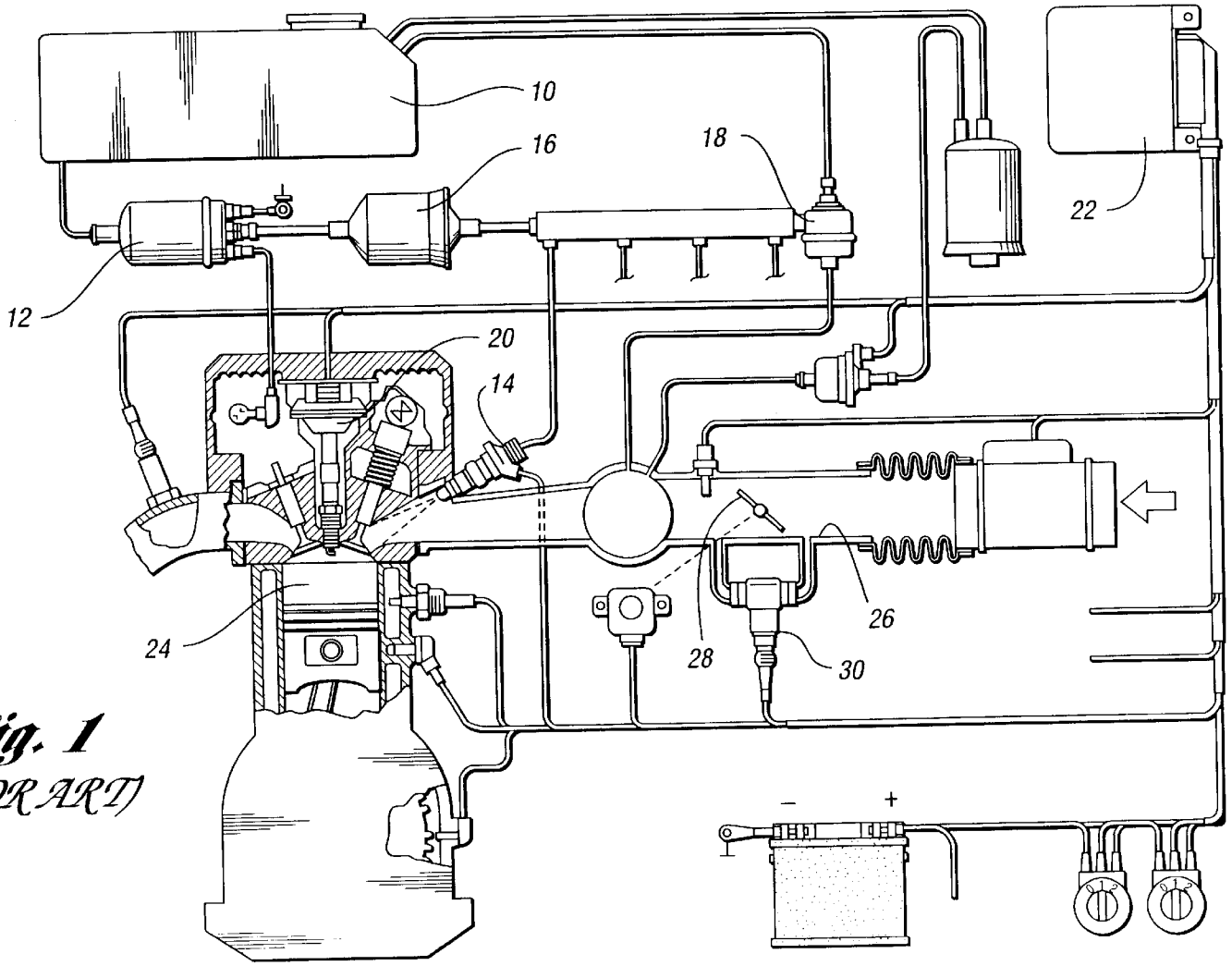
Fig. 1 (PRIOR ART)
FIG. 1 shows in schematic form a prior art air intake manifold for an internal combustion engine for an automobile, including a throttle plate situated on the upstream side of a fuel injector.

FIG. 1 shows in schematic form a prior art fuel and air induction system for an internal combustion engine. The fuel tank is shown at 10. Fuel pump 12 supplies fuel to injector 14 through filter 16 under a pressure that is regulated by pressure regulator 18. A spark plug assembly 20 under the control of an electronic control unit 22 ignites an air/fuel mixture in a combustion chamber 24.

An airflow intake passage is shown at 26. A throttle plate 28 is rotatably mounted in the airflow passage 26 adjacent an idle speed actuator 30 on the upstream side of injector 14.

Figure 2:
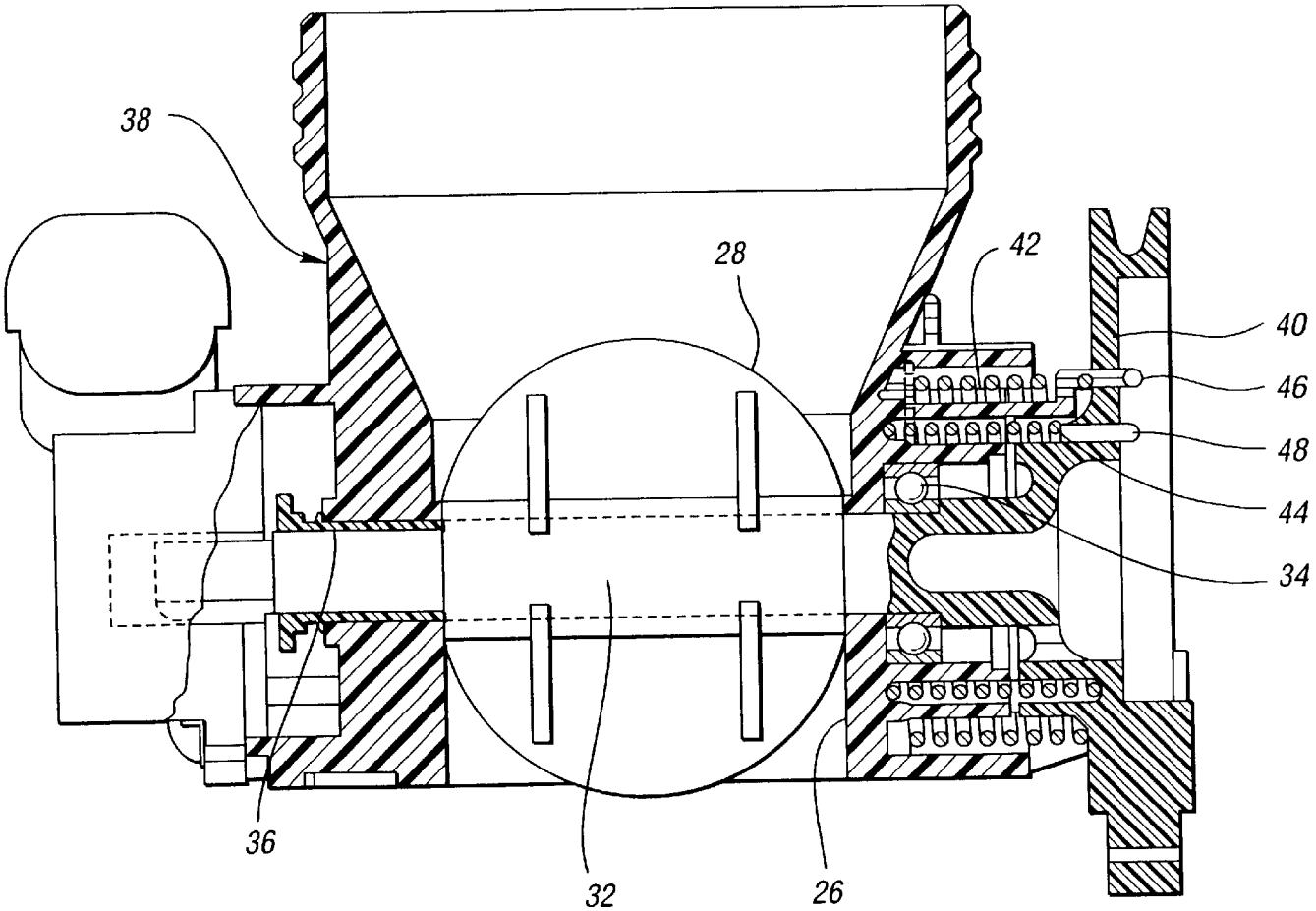
Fig. 2 (PRIOR ART)
FIG. 2 is a schematic representation of a prior art throttle plate construction including a fixed throttle shaft that supports a throttle plate as part of a fixed assembly.

FIG. 2 shows in schematic form a prior art throttle plate assembly for use with an engine of the kind shown in FIG. 1. The throttle plate 28 is secured in a fixed fashion to throttle shaft 32 which extends diametrically across the airflow passage 26. The shaft 32 is straddle mounted by bearings 34 and 36 in the throttle body generally indicated by reference numeral 38.

The shaft 32 extends to a throttle actuator such as a cam or lever 40 mounted on one side of the throttle body 38. Return coil springs 42 and 44 are situated within enclosures formed respectively on the throttle body and on the lever or cam 40 for the purpose of normally adjusting the throttle plate 28 to a closed throttle position. The outboard ends of springs 42 and 44 are secured as shown at 46 and 48, to the cam or lever 40; and the opposite ends are secured to the throttle body 38, as shown. The springs are pre-stressed to normally apply a torque on shaft 32 which tends to move the throttle plate to its closed position.

Figure 4:
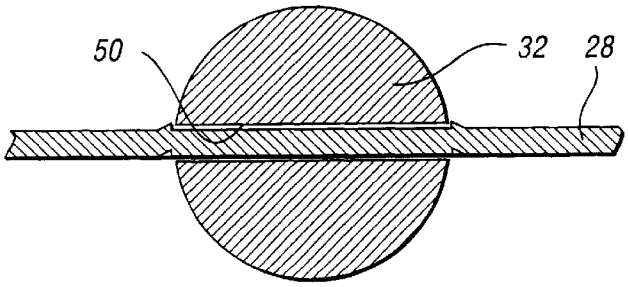
FIG. 4 is a cross-sectional view taken along the plane of section line 4—4 of FIG. 3.

The improved throttle plate assembly of the invention includes a shaft 32, which is slotted as shown in FIG. 4 at 50. Throttle plate 28 is received in the slot 50. The dimensions of the slot 50 permit a sufficient clearance between the walls of the slot and the shaft 32 to allow for a limited degree of angular motion of the plate 28 relative to the shaft 32.

Figure 3:
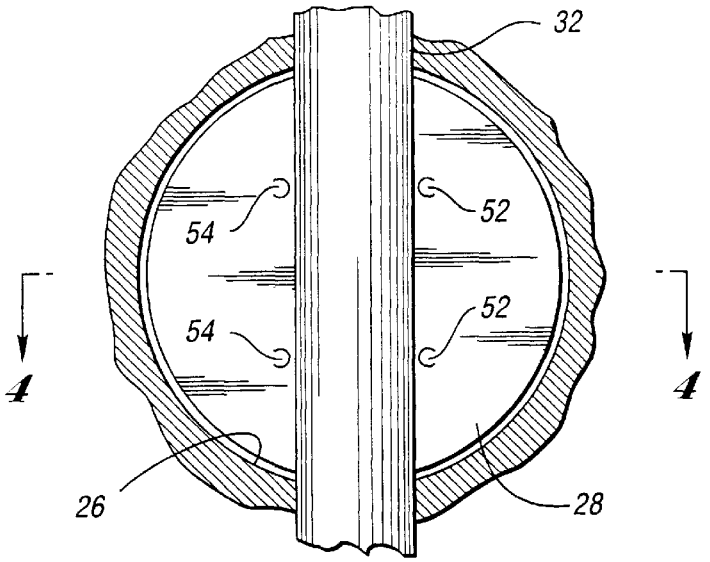
FIG. 3 is a plan view of a throttle shaft and throttle plate assembly of a first embodiment of the invention.

Plate 28 of the invention is provided with a pair of dimples 52 on one side of the shaft 32 and a companion pair of dimples 54 on the opposite side of the shaft 32, as seen in FIGS. 3 and 4. The spacing between the dimples 52 and 54 is greater than the diameter of the shaft so that a limited degree of shifting motion of the throttle plate 28 in a direction transverse of the axis of the shaft may occur. The amount of transverse shifting motion of the plate 28 that is permitted by the spacing of the dimples is limited so that interference will not occur between the wall of the airflow passage 26 and the outer periphery of the plate 28. The throttle plate and the airflow passage, furthermore, are sized to allow limited shifting in the direction of the axis of the shaft.

Figure 5:
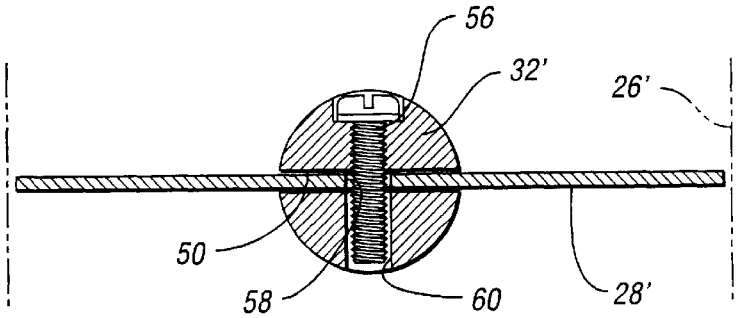
FIG. 5 is a cross-sectional view of a second embodiment of the invention taken along a diametrical cross-sectional plane.

FIG. 5 shows an alternate arrangement for securing the throttle shaft 32' to the throttle plate 28'. As in the case of the embodiment of FIGS. 3 and 4, the shaft 32' of the embodiment of FIG. 5 has a slot 50' that receives the throttle plate 28. A sufficient clearance is provided between the throttle plate 28' and the walls of the slot 50' to allow for limited and controlled angular adjustment of the plate 28' relative to the shaft 32'.

A screw 56 is received in the shaft 32' at a location corresponding to the axis of the airflow passage 26'. Screw 56 extends through an oversized clearance opening 58 in the center of the throttle plate 28' and through an oversized clearance opening 60 in the shaft 32'.

Figure 6:
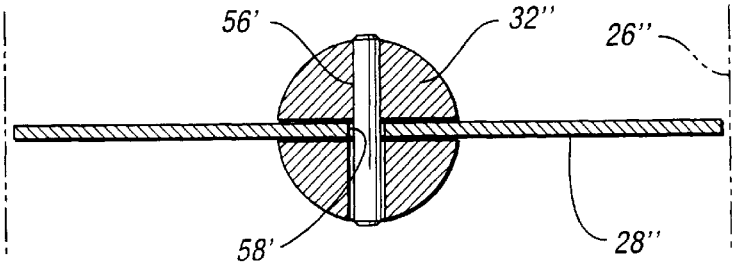
FIG. 6 is a view, corresponding to FIG. 5, which includes an alternate retainer for securing the throttle plate to the throttle shaft.

In the embodiment of FIG. 6, the screw is replaced by a yieldable spring pin 56' which is secured by a press-fit in the upper half of the shaft 32" and which extends through an oversized opening 58' in the throttle plate 28". The lower half of the shaft 32" has an oversized opening that receives the lower end of the spring pin 56', as seen in FIG. 6. As in the case of the embodiment of FIGS. 3 and 4, the embodiments of FIGS. 5 and 6 will permit a floating action between the throttle plate and the throttle shaft within the airflow passage in the throttle body, thereby preventing interference between the perimeter of the throttle plate and the wall of the airflow passages.

In FIGS. 5 and 6, prime notations for the numerals are used where those numerals have a counterpart in the embodiment of FIGS. 3 and 4.

Modifications to the invention as described may be made by persons skilled in the art without departing from the scope of the invention. Such modifications and equivalents thereof are within the scope of the appended claims.

What is claimed is:

1. A throttle body for an internal combustion engine comprising an airflow passage in the throttle body;

a throttle plate in said airflow passage, said throttle plate conforming generally to the interior dimensions of the airflow passage;

a throttle shaft extending diametrically across said airflow passage;

means for rotatably adjusting said throttle shaft and said throttle plate about a throttle shaft axle to effect angular control of said throttle plate; and a connection between said throttle shaft and said throttle plate including a slot in said throttle shaft that receives said throttle plate, said slot having a width that defines a clearance between said throttle plate and said throttle shaft to effect a controlled floating motion of said throttle plate relative to said throttle shaft thereby avoiding interference between said throttle plate and said throttle body;

said connection between said throttle shaft and said throttle plate comprising spaced pairs of projections on at least one side of said throttle plate, said pairs being located on opposite sides of said throttle shaft;

the spacing between said pairs being greater than the diameter of said throttle shaft thereby permitting limited transverse adjustment of said throttle plate in said slot relative to said throttle shaft and accommodating limited adjustment of said throttle plate in the direction of the axis of said throttle shaft.

* * * * *